US005260749A

United States Patent [19]

Yahata

[11] Patent Number: 5,260,749

[45] Date of Patent: Nov. 9, 1993

[54] TONER CARTRIDGE

[75] Inventor: Masasumi Yahata, Yokohama, Japan

[73] Assignee: Ricoh Company, Ltd., Tokyo, Japan

[21] Appl. No.: 779,052

[22] Filed: Oct. 18, 1991

[30] Foreign Application Priority Data

Oct. 23, 1990 [JP] Japan ..... 2-284983

[51] Int. Cl.[5] ..... G03G 15/06

[52] U.S. Cl. ..... 355/260; 355/215; 222/DIG. 1

[58] Field of Search ..... 222/DIG. 1; 277/12, 277/80; 355/215, 245, 260

[56] References Cited

U.S. PATENT DOCUMENTS 3,561.647 2/1971 Altmann .
4,693,938 10/1980 Sonoda et al. .
4,778,086 10/1988 Shibata et al. .
4,799,608 1/1989 Oka ..... 222/DIG. 1
4,969,557 11/1990 Oka ..... 222/DIG. 1
4,998,140 3/1991 Satou et al. ..... 355/245
5,030,998 4/1991 Shibata et al. ..... 355/260
5,080,745 1/1992 Paull ..... 222/DIG. 1

FOREIGN PATENT DOCUMENTS 0400623 12/1990 European Pat. Off. .
2-230165 11/1990 Japan .

*Primary Examiner*—Michael L. Gellner
*Assistant Examiner*—P. J. Stanzione
*Attorney, Agent, or Firm*—Oblon, Spivak, McClelland, Maier & Neustadt

[57] ABSTRACT

A toner cartridge for supplying a toner to the toner hopper of a developing apparatus incorporated in image forming equipment. A take-up roller is rotatably mounted on a case which stores a toner therein. A seal member covers an opening formed in the bottom of the case and is affixed to the take-up roller at one end thereof. The seal member is automatically attached to and detached from the case without resorting to manual operations.

9 Claims, 13 Drawing Sheets

TONER CARTRIDGE

BACKGROUND OF THE INVENTION

The present invention relates to a toner cartridge for supplying a toner to a toner hopper incorporated in the developing apparatus of a copier, printer or similar image forming equipment.

A toner cartridge for the above application is removably mounted on a developing apparatus and has an opening for letting a toner fall into the apparatus therethrough. A seal member covers the opening of the toner cartridge and has customarily been detached when the cartridge is inserted into the developing apparatus and attached when the former is pulled out of the latter. The problem with this kind of toner cartridge is that the toner is scattered around when the seal member is detached from or attached to the cartridge. Means for stripping the seal member when the cartridge is inserted into the developing apparatus is conventional and implemented as a pick-up roller and a driving device mounted on the developing apparatus or a shutter mounted on the cartridge. However, the pick-up roller and driving device scheme is troublesome because the seal member of the toner cartridge has to be affixed to the take-up roller which is mounted on the developing apparatus. The shutter scheme is not satisfactory because the shutter cannot fully peel off the seal member when simply moved into and out of the developing apparatus, i.e., the seal member has to be fully stripped by hand.

SUMMARY OF THE INVENTION

It is, therefore, an object of the present invention to provide a toner cartridge which is replaceable with ease while preventing a toner stored therein from leaking.

It is another object of the present invention to provide a generally improved toner cartridge.

A toner cartridge for supplying a toner to a toner hopper incorporated in a developing apparatus of the present invention comprises a case having an opening at the bottom thereof, a sheet-like seal member detachably fitted on the case for covering the opening, and a take-up roller rotatably mounted on the case. The seal member is affixed to the take-up roller at one end thereof. The take-up roller rotates to take up the seal member to thereby uncover the opening.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
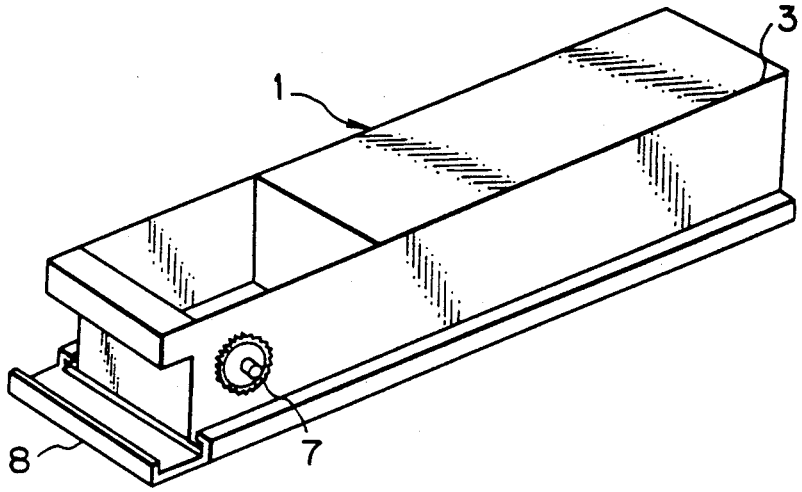
FIG. 1 is a perspective view showing a toner cartridge embodying the present invention.
Figure 2:
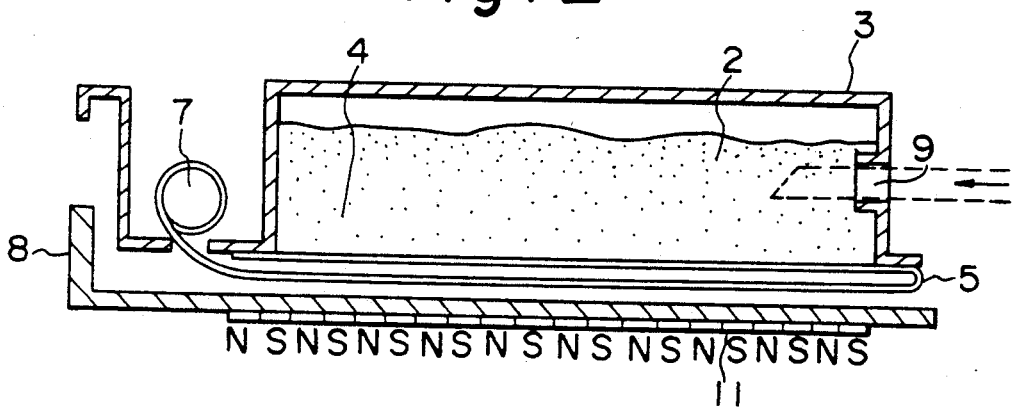
FIG. 2 is a sectional front view of the embodiment.
Figure 3:
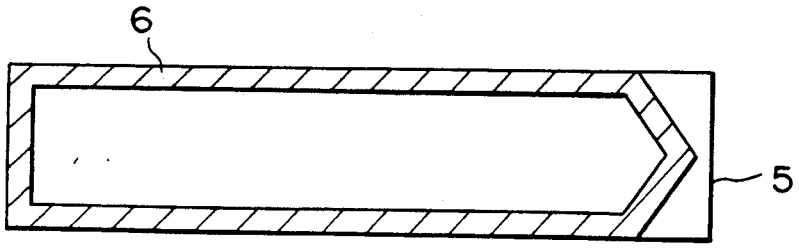
FIG. 3 is a plan view showing the area to which a seal member is adhered by fusion.

Referring to FIGS. 1 and 2 of the drawings, a toner cartridge embodying the present invention is shown and generally designated by the reference numeral 1. As shown, the toner cartridge 1 has a box-like case 3 storing a toner 2 therein. The case 3 has an opening 4 at the bottom thereof to allow the toner 2 to be charged and discharged. After the toner 2 has been filled in the case 3, the opening 4 is closed by a seal member in the form of a sheet 5. The seal member 5 is connected to the edges 6 of the case 3 surrounding the opening 4 by fusion, as indicated by hatching in FIG. 3. The seal member 5 is folded back at one end of the case 3 and has the free end thereof inserted into or adhered to a take-up roller 7. The take-up roller 7 is located in close proximity to the end of the case 3 opposite to the end where the seal member 5 is folded back. Specifically, the take-up roller 7 is rotatably mounted on the case 3 and takes up the seal member 5 when rotated. The bottom of the case 3 having the opening 4 is so configured as to allow a shutter 8 to slide 8 therealong. The shutter 8 conceals the opening 4 and seal member 5. If desired, a toner inlet 9 may be formed in the case 3 and stopped by a cap 10, FIG. 9.

Figure 4:
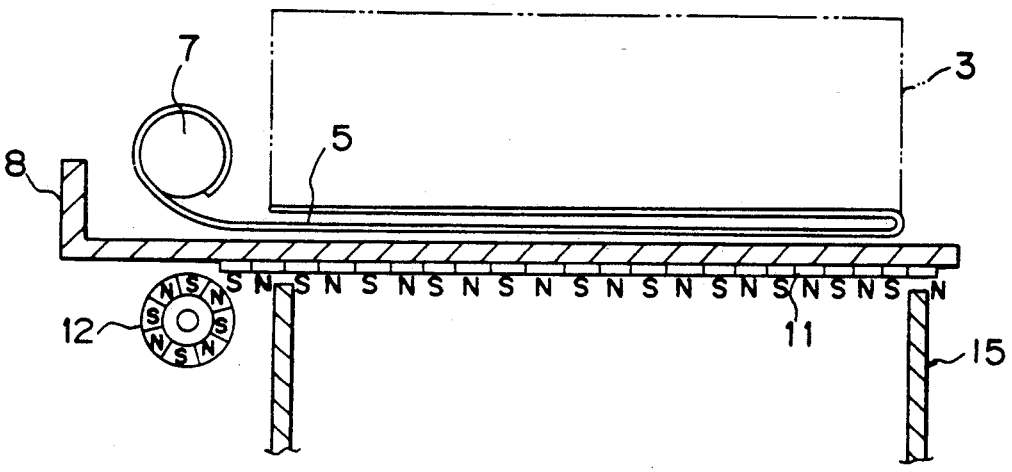
FIG. 4 is a view showing the toner cartridge shown in FIG. 1 mounted on a developing apparatus.
Figure 5:
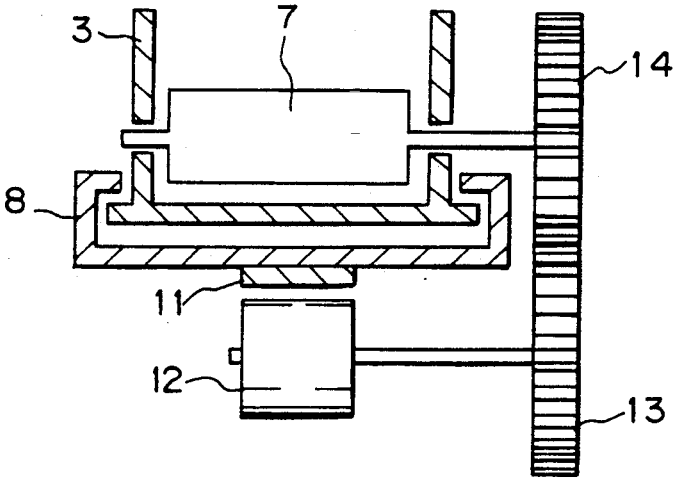
FIG. 5 is a sectional side elevation associated with FIG. 4.

After the toner cartridge 1 storing a fresh toner 2 has been set in a predetermined position on a developing apparatus 15, FIG. 4, the seal member 5 is stripped from the case 3 to uncover the opening 4. As a result, the toner 2 is supplied from the case 3 to the developing apparatus, e.g., a toner hopper. In this embodiment, as the shutter 8 is pulled out, the take-up roller 7 is rotated to take up the seal member 5 to thereby uncover the opening 4. As shown in FIGS. 2, 4 and 5, the take-up roller 7 is rotated by drive means which is implemented as a disk-like flat magnet 11 and a cylindrical magnet 12. The magnets 11 and 12 are respectively mounted on the bottom of the shutter 8 and the developing apparatus 15, and each is magnetized to the S and N poles alternately at a predetermined pitch. A drive gear 13 is rotatable integrally and coaxially with the cylindrical magnet 12 and held in mesh with a driven gear 14 which is mounted coaxially with the take-up roller 7. When the toner cartridge 1 is set in the predetermined position on the developing apparatus 15, the driven gear 14 is brought into mesh with the drive gear 13. When the shutter 8 is pulled to the left as viewed in FIG. 4, the magnet 11 affixed to the shutter 8 rotates the magnetic 12 by magnetism in synchronism therewith. The rotation of the magnet 12 is transmitted to the take-up roller 7 via the drive gear 13 and driven gear 14. As a result, the take-up roller 7 takes up the seal member 5 to uncover the opening 4, thereby letting the toner 2 fall into the developing apparatus 15.

Figure 6:
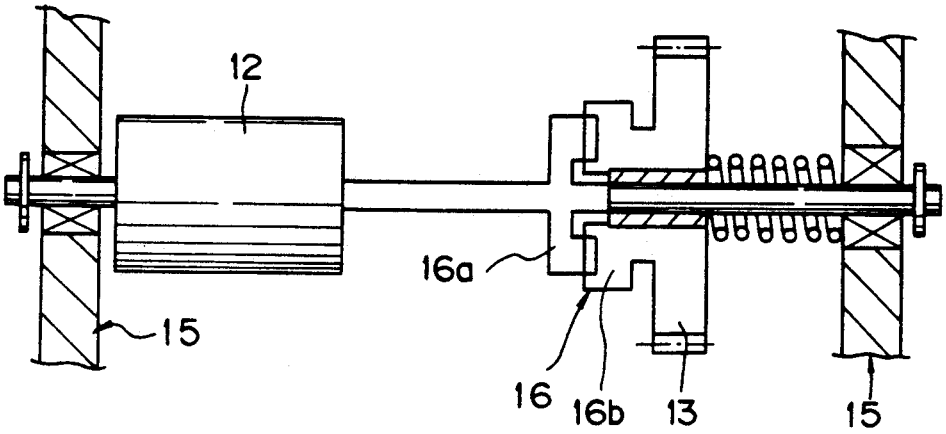
FIG. 6 is a section showing connecting means.
Figure 7A:
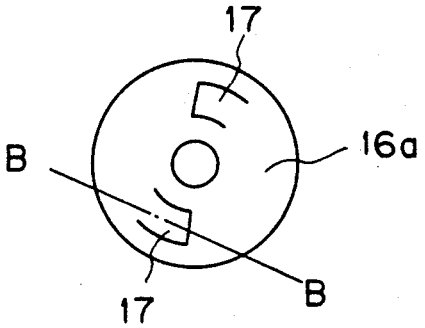
FIG. 7A is an end view of a connecting plate included in the connecting means.
Figure 7B:
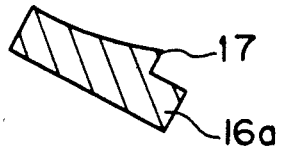
FIG. 7B is a section along line B—B of FIG. 7A.

After the supply of the toner into the apparatus 15, the shutter 8 is again pushed into the apparatus 15 to cover the opening 4. In this condition, the toner having been used by the apparatus 15, i.e., waste toner is collected in the toner cartridge 1 via the inlet 9. When the shutter 8 is pushed into the apparatus 15 for closing the opening 4, the rotation of the magnet 12 should be prevented from being transmitted to the take-up roller 7. For this purpose, a one-way clutch 16 may intervene between the magnet 12 and the drive gear 13, as shown in FIG. 6. The one-way clutch 16 may be implemented as a drive disk **16*a* and a driven disk 16*b* each being provided with pawls 17, as shown in FIGS. 7A and 7B. The pawls 17 engage with each other in response to a rotation in one direction, but they do not engage in response to a rotation in the other direction. The flat magnet 11 affixed to the shutter 8 does not interfere with the seal member 5 when the shutter 8 is moved into and out of the apparatus 15**.

The toner cartridge 1 having the above construction plays the role of a waste toner bottle after it has released the toner 2 into the developing apparatus 15.

Figure 8:
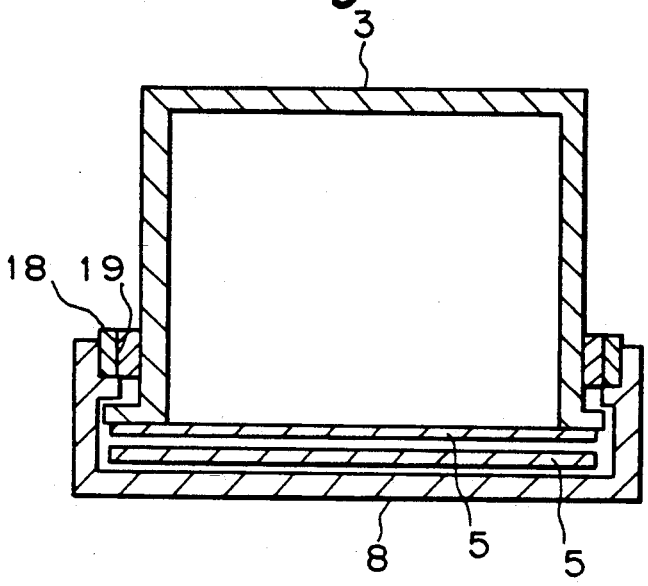
FIG. 8 is a section indicative of a relation between a case and a shutter.
Figure 9:
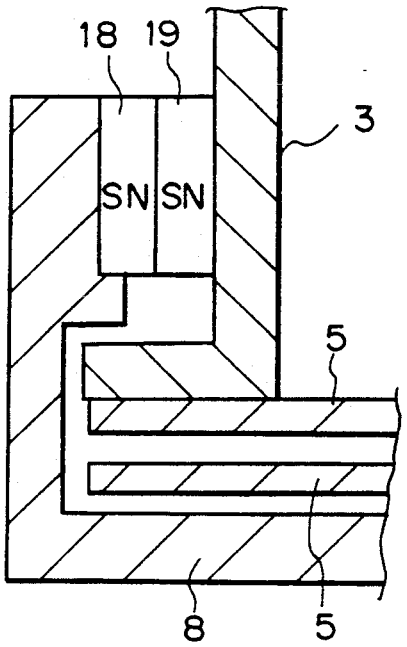
FIG. 9 is a fragmentary enlarged view associated with FIG. 8.

In order that the shutter 8 may readily move on and along the case 3, a gap is necessarily formed in a guide arrangement between the shutter 8 and the case 3. Such a gap would cause the waste toner collected in the case 3 to leak. In light of this, as shown in FIGS. 8 and 9, first flat magnets 18 are affixed to the shutter 8 while second flat magnets 19 are affixed to the case 3 such that each faces one of the first magnets 18. The associated first and second magnets 18 and 19 face each other at opposite poles, i.e., N and S poles thereof. The magnets 18 and 19 are so positioned as to contact each other to prevent the toner from leaking to the outside via the gap between the case 3 and the shutter 8. The magnets 18 and 19 readily slide on each other when a weak force is applied thereto, but they do not separate from each other unless a strong force is applied. Even when toner particles or similar fine impurities enter the interstice between the case 3 and the shutter 8, the magnets 18 and 19 which contact each other surely prevent the toner from leaking to the outside. If desired, either one of the magnets 18 and 19 may be replaced with a magnetic member such as a plate of iron.

Figure 10:
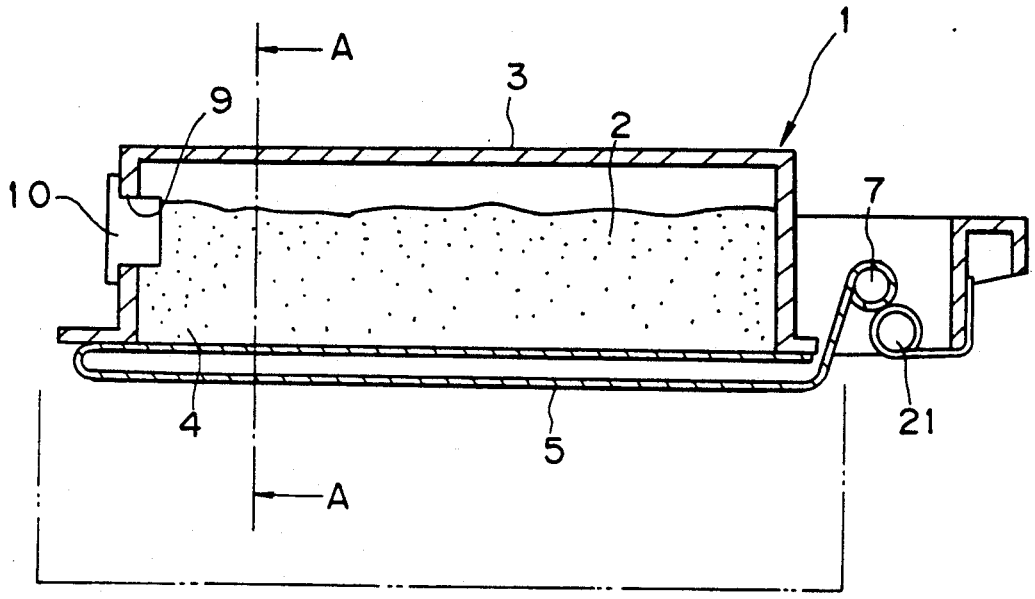
FIG. 10 is a sectional front view showing an alternative embodiment of the present invention.
Figure 11:
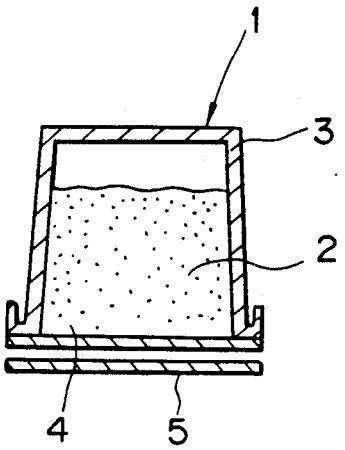
FIG. 11 is a sectional side elevation associated with FIG. 10.

While the embodiment shown in FIGS. 1-9 uses a shutter, the shutter may be omitted, as shown in FIGS. 10 and 11. Then, an adhesive tape is used to allow the case 3 to serve as a waste toner bottle after it has released the fresh toner. In FIG. 9 and successive figures, the same or similar parts and elements are designated by like reference numerals, and redundant description will be avoided for simplicity.

Figure 12:
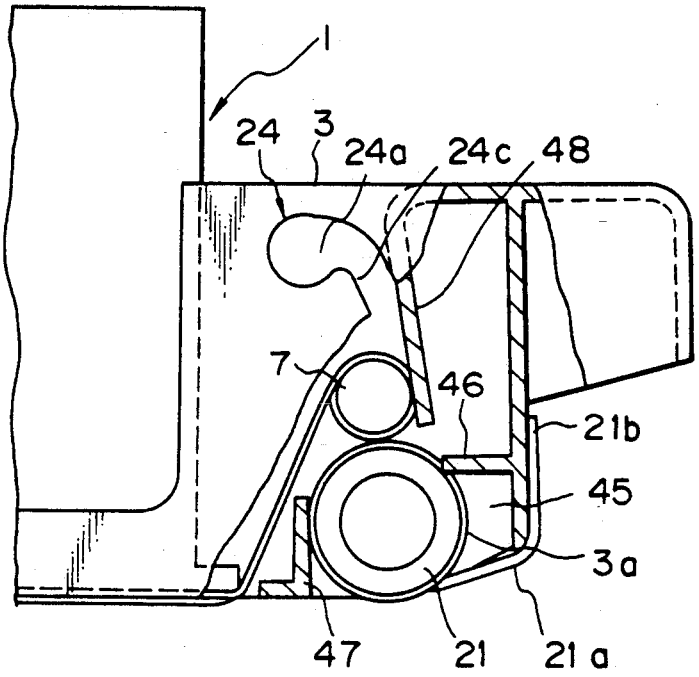
FIG. 12 is a fragmentary section showing an end potion of a case included in the alternative embodiment.
Figure 13:
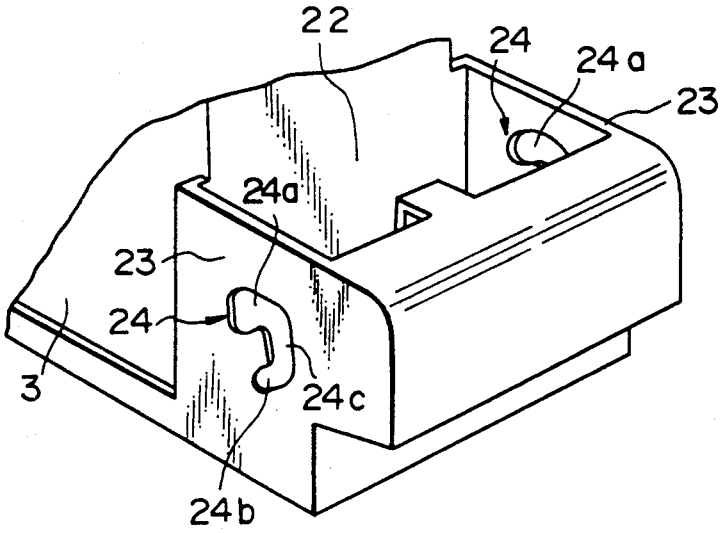
FIG. 13 is a fragmentary perspective view associated with FIG. 12.
Figure 14:
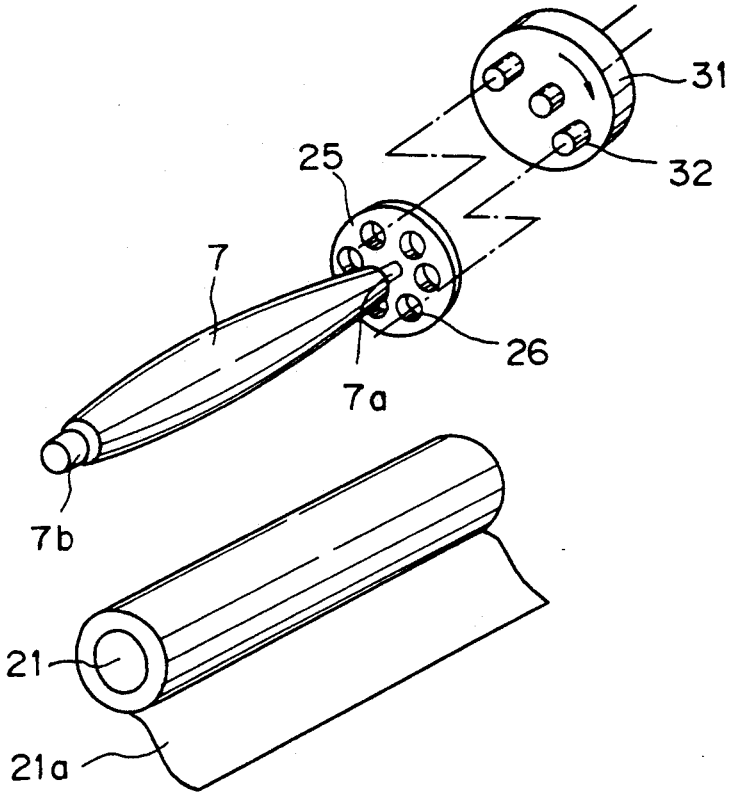
FIG. 14 is a perspective view showing a take-up roller and an adhesive tape.

As shown in FIGS. 10 and 12, an adhesive tape **21*a* is wound around a tape roller 21 which is disposed below the take-up roller 7. As shown in FIG. 13, the case 3 has a space 22 for accommodating the take-up roller 7 and tape roller 21. Opposite side walls 23 which define the space 22 are each formed with a slot 24 made up of three contiguous portions 24*a*, 24*b* and 24*c*. Opposite ends 7*a* and 7*b* of the take-up roller 7 are first inserted into the portions 24*a* of the slots 24, and then moved to the portions 24*b* via the guide portions 24*c*. The ends 7*a* and 7*b* of the take-up roller 7 are rotatably supported in the portions 24*b* of the slot 24. In this position, the take-up roller 7 is located above the tape roller 21, as shown in FIGS. 12 and 14**.

Figure 16:
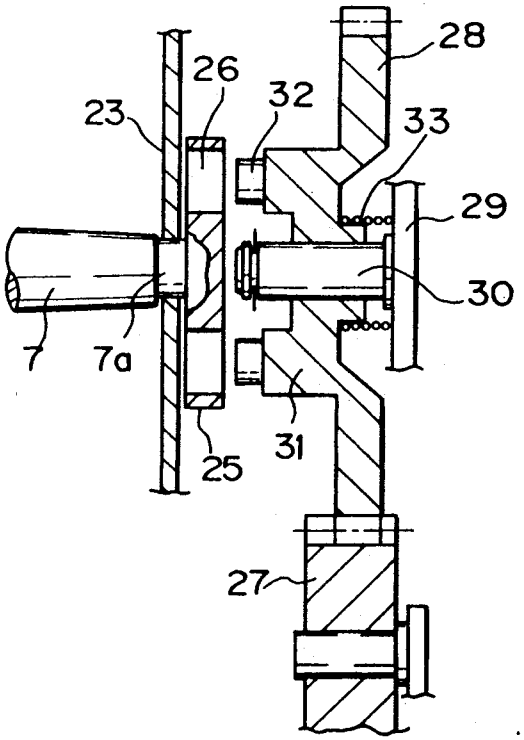
FIG. 16 is a section associated with FIG. 15.
Figure 15:
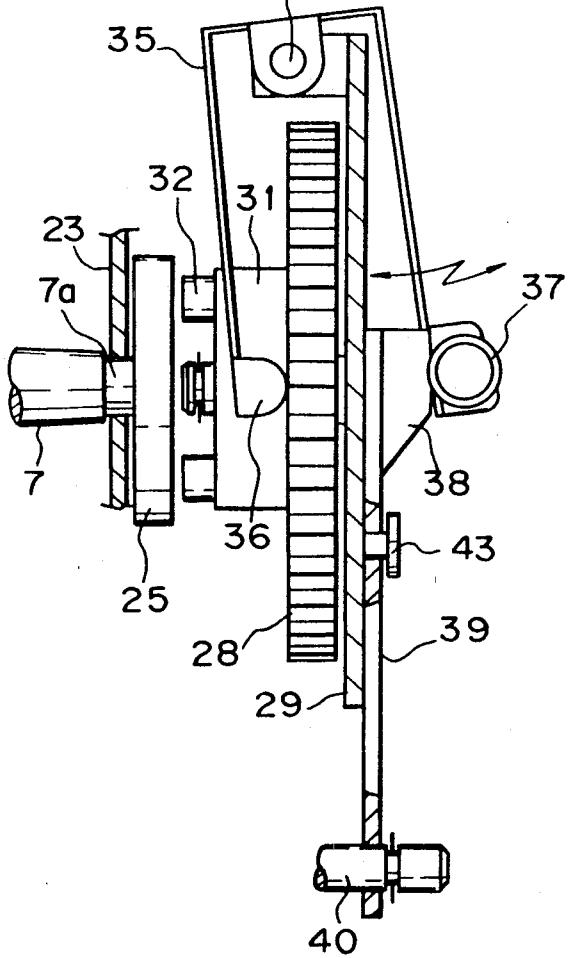
FIG. 15 is a front view representative of the connection of the take-up roller and a drive section.

As shown in FIGS. 15 and 16, a connecting plate 25 is affixed to the take-up roller 7 and formed with a plurality of holes 26. A shaft 30 is affixed to the frame 29 of the developing apparatus 15. A driven gear 28 is rotatably mounted on the shaft 30 and held in mesh with a drive gear 27 which is included in a drive device, not shown. The driven gear 28 has a boss 31 on which a plurality of pins or connecting members 32 are studded. The pins 32 can mate with the holes 26 of the above-mentioned connecting plate 25. A spring 33 is preloaded between the frame 29 and the driven gear 28 for constantly biasing the gear 28 toward the connecting plate 25, i.e., constantly urging the pins 32 into the holes 25 of the plate 25. A release lever 35 is rotatably mounted on the frame 29 by a fulcrum and has a projection 36 which abuts against one end of the driven gear 28. When the release lever 35 is rotated about the fulcrum 34, the projection 36 urges the driven gear 28 away from the connecting plate 25 to thereby release the former from the latter. A roller 27 is rotatably supported by the other end of the release lever 35 remote from the projection 36 while a cam 38 extends out from an intermediate lever 39. The roller 37 is held in contact with and moved by the cam 38.

Figure 17:
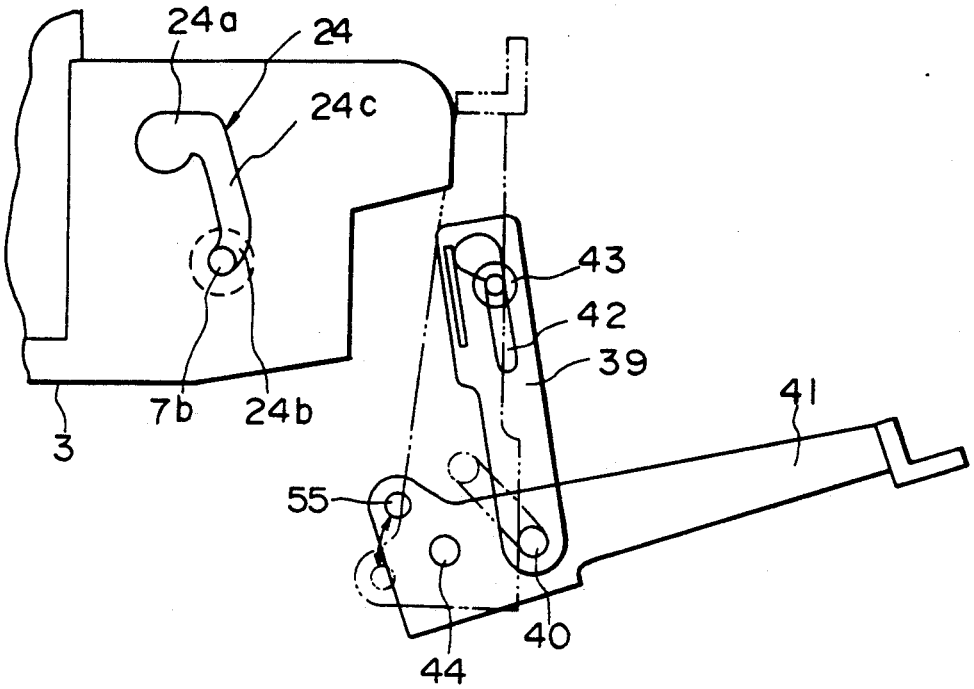
FIG. 17 is a view showing a relation between the case and a release lever.

As shown in FIGS. 15 and 17, the other end of the intermediate lever 39 remote from the cam 38 is rotatably connected to an operating lever 41 by a pin 40. A pin studded on the frame 29 is received in a slot 42 formed in the intermediate lever 39. When actuated by the operating lever 41, the intermediate lever 39 moves in substantially the up-and-down direction with the edges of the slot 42 sliding on the pin 43. The operating lever 41 is connected to the frame 29 by a shaft 44 and rotatable about the shaft 44 between a connecting and a releasing position which are indicated by a solid line and a dash-and-dots line, respectively. When the operating lever 41 is in the releasing position, the cam 38 urges the roller 37 to move the release lever 38 to the position shown in FIG. 15, thereby holding the driven gear 31 in the released position. When the operating lever 41 is in the connecting position, the intermediate lever 39 is raised to in turn move the cam 38. As a result, the roller 37 is freed from the pressure force having acted thereon. Then, the driven gear 28 is moved by the spring 33 until the pins 32 mate with the holes 26 of the connecting plate 25, whereby the driven gear 28 is connected to the take-up roller 7. While the driven gear 28 is release from the take-up roller 7, the toner cartridge 1 can be freely moved into and out of the developing apparatus 15. After the cartridge 1 has been set in a predetermined position, the operating lever 41 is moved to connect the driven gear 28 to the take-up roller 7. When the drive gear 27 is driven by the drive device, the take-up roller 7 is rotated to take up the seal member 5. As a result, the opening 4 is uncovered to let the toner fall into the apparatus 15.

Toner end sensing means is built in the developing apparatus 15, although not shown in the figures. When the toner end sensing means determines that the apparatus 15 has run out of toner, the toner cartridge 1 has to be replaced.

The adhesive tape 21*b* is paid out from the tape roller 21 accommodated in the space 33 of the case 3, pulled out of the case 3 via an opening formed in a lower portion of the case 3, and adhered to the end wall 3*a*, FIG. 12, of the case 3 at the end 21*b* thereof. Preferably, the tape 21*b* is about 0.13 millimeter thick and has a base thereof implemented by craft paper. While the base of the tape 21*b* may be comprised of cellophane or polyethylene experiments showed that an adhesive tape with such a base adheres too strongly to itself. In the space 22, the tape roller 21 is retained by projections 45 and 46 and a pressing plate 47 and does not easily fall, but it falls from the case 3 when pressed downward by a force greater than a predetermined force. The take-up roller 7 rotatably received in the portions 24*b* of the slots 24 is pressed by a press plate 48, so that it may not slip out of the portions 24*b*. As the take-up roller 7 is rotated by the driven roller 28 to take up the seal member 5, the diameter of the roller 7 sequentially increases. Finally, the seal member 5 taken up by the roller 7 contacts the outer periphery of the tape roller 21 and sequentially pushes it downward until the tape roller 21 falls to the lower portion of the case 3.

Figure 18A:
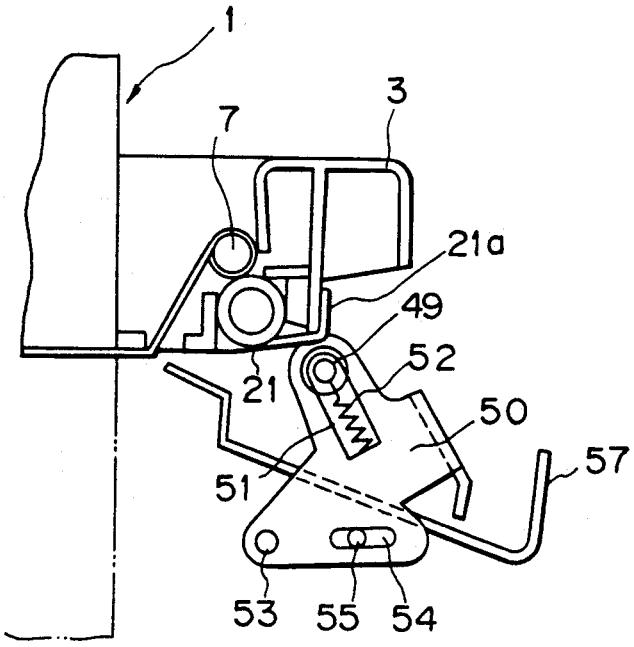
FIGS. 18A–18E are views showing conditions successively occurring when the case is pulled out.
Figure 18B:
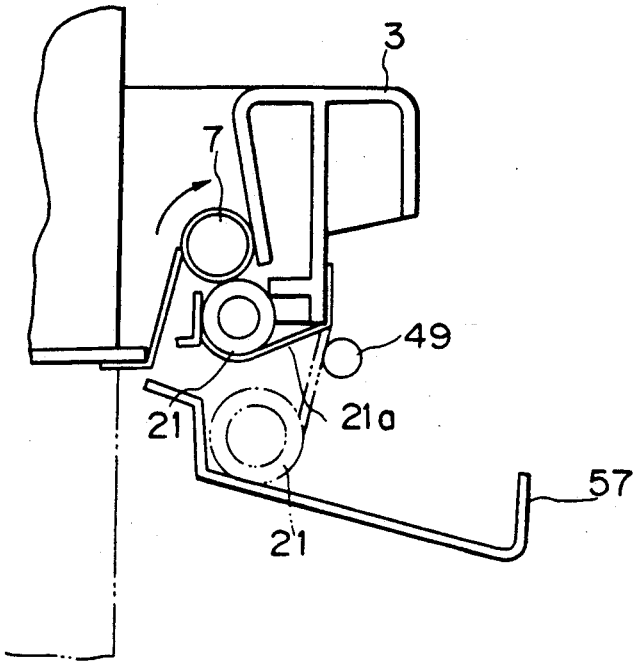
Figure 19:
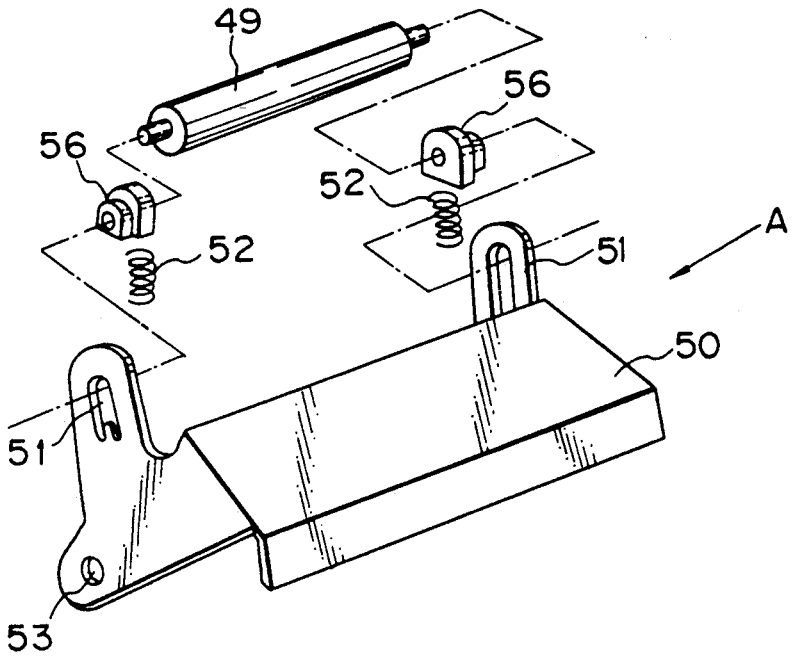
FIG. 19 is an exploded perspective view of a support plate.
Figure 20:
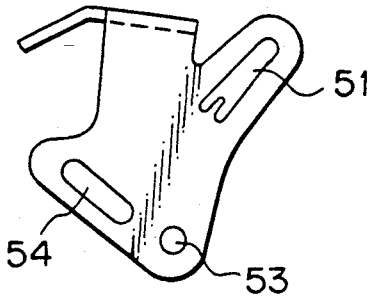
FIG. 20 is a view as seen in a direction indicated by an arrow A in FIG. 19.

As shown in FIGS. 18A and 19, sliders 56 are slidably supported by a support plate 50. A press roller 49 is rotatably supported by the sliders 56 and, when the toner cartridge 1 is set in the predetermined position, presses the adhesive tape 21*a* against the case 3. The sliders 56 are each movable in and along a slot 51 formed in the support plate 50 and constantly pressed by a spring 52 against the case 3. The support plate 50 is rotatably connected to the frame 29 by a pin 53. A pin 55, FIG. 17, studded on the operating lever 41 is received in a slot 54 which is formed in the support plate 50. When the operating lever 41 is in the connecting position indicated by a phantom line in FIG. 17, the support plate 50 is in a pressing position shown in FIG. 18A in which it urges the tape 21*a* against the press roller 49. As the diameter of the take-up roller 7 increases, the tape roller 21 falls onto a tray 57, as indicated by a dash-and-dots line in FIG. 18B. However, the end of the tape 21*a* is continuously pressed against the case 3 by the press roller 49.

Figure 18C:
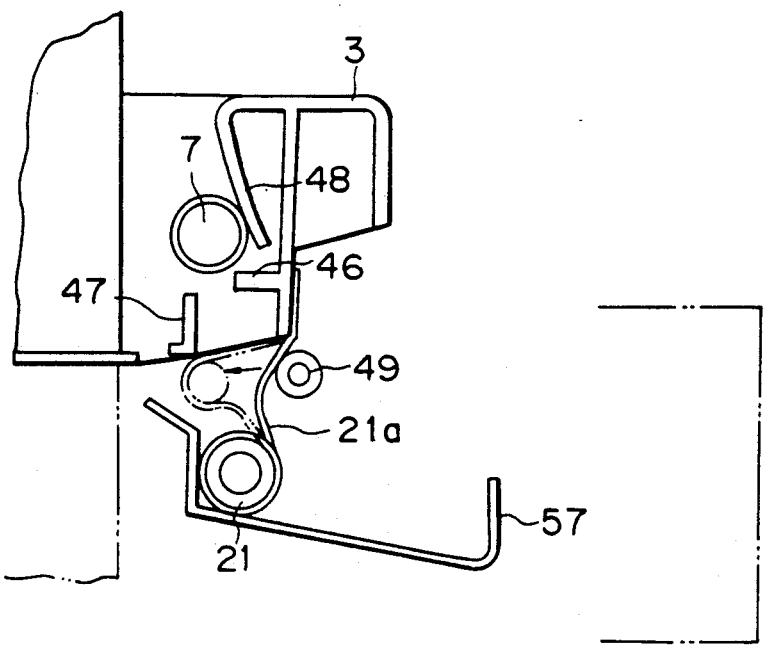
Figure 18D:
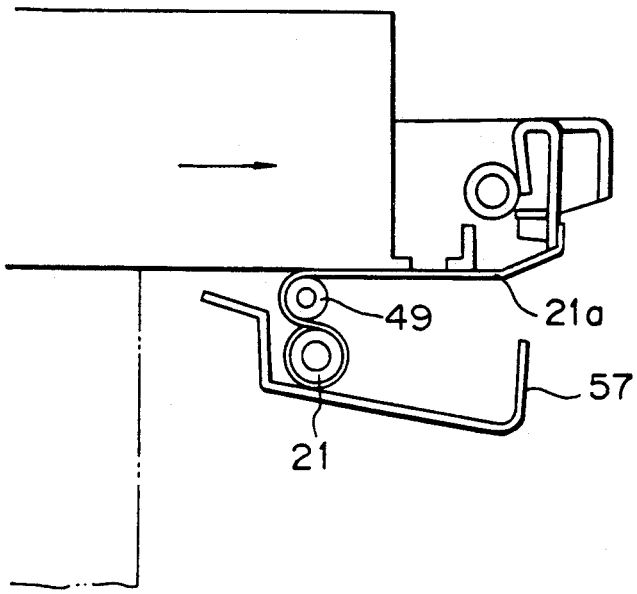
Figure 18E:
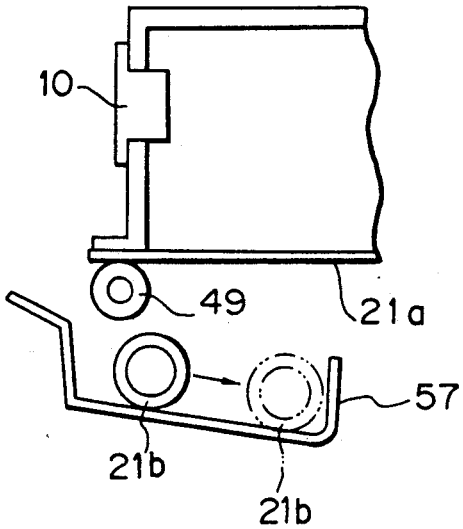

Assume that the operating lever 41 is moved to the releasing position indicated by a solid line in FIG. 17 in order to replace the toner cartridge 1. Then, the support plate 50 is rotated counterclockwise, as viewed in FIG. 8A, via the pin 55 and, therefore, counterclockwise about the pin 53. As a result, as shown in FIG. 18C, the press roller 49 is moved in a direction indicated by an arrow while remaining in contact with the case 3. Hence, the tape 21*a* is paid out from the tape roller 21 and adhered to the bottom of the case 3. At this instant, the press roller 49 is urged against the bottom of the case 3 by the springs 52. As shown in FIG. 18D, as the case 3 is pulled in a direction indicated by an arrow, i.e., to the right, the tape 21*a* is sequentially paid out and adhered to the bottom of the case 3 because the press roller 49 is substantially fixed in place. As shown in FIG. 18E, at the time when the tape 21*a* covers the bottom of the case 23 to the rear end of the latter, only the core 21*b* of the tape roller 21 is left and rolls down on the tray 57 to a position indicated by a dash-and-dots line. Then, the operator can readily pick up the core 21*b*.

After the used toner cartridge 1 has been removed, a fresh toner cartridge is mounted. Then, the operating lever 41 is moved to the connecting position to set up the condition shown in FIG. 18A.

Figure 21:
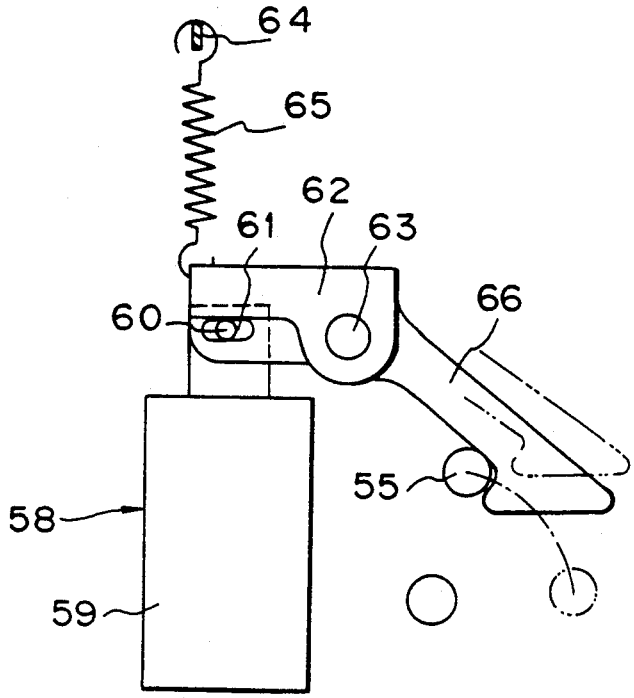
FIG. 21 is a view showing a locking device.

FIG. 21 shows a locking device 58 for preventing the operating lever 41 from being moved, i.e., preventing the toner cartridge 1 from being removed, except for a particular condition which will be described. The locking device 58 has a solenoid 59 and a lock lever 62 connected to the plunger of the solenoid 59 via a pin 60 and a slot 61. The lock lever 62 is rotatably connected to the frame 29 by a pin 63. The lock lever 62 has a pawl 66 capable of engaging with the pin 55 of the operating lever 41 so as to lock the lever 41 in the dash-and-dots line position. A spring 65 is anchored at one end to the lock lever 62 and at the other end to a pin 64 studded on the frame 29, constantly biasing the pawl 66 to a position where it engages with the pin 55. The solenoid 59 is energized in a particular condition, e.g., when the toner end sensing means has detected a toner end condition. Then, the solenoid 59 pulls the lock lever 62 against the action of the spring 65 with the result that the pawl 66 is released from the pin 55. Only in this condition, the operating lever 41 can be moved to the releasing position.

As shown in FIG. 14, the take-up roller 7 has a configuration resembling a hand drum. The diameter of this roller 7 is about 10 millimeters at the center and about 8 millimeters at opposite ends. Such a configuration prevents the seal member 5 from being dislocated or broken when taken up by the roller 7. The roller 7 may be made of polycarbonate. When the roller 7 was configured to take up the seal member 5 over a width of 108 millimeters and a constant diameter of 8 millimeters, it dislocated or broken the seal member 5; when the diameter was greater than 9 millimeters, such an occurrence was eliminated.

Figure 22:
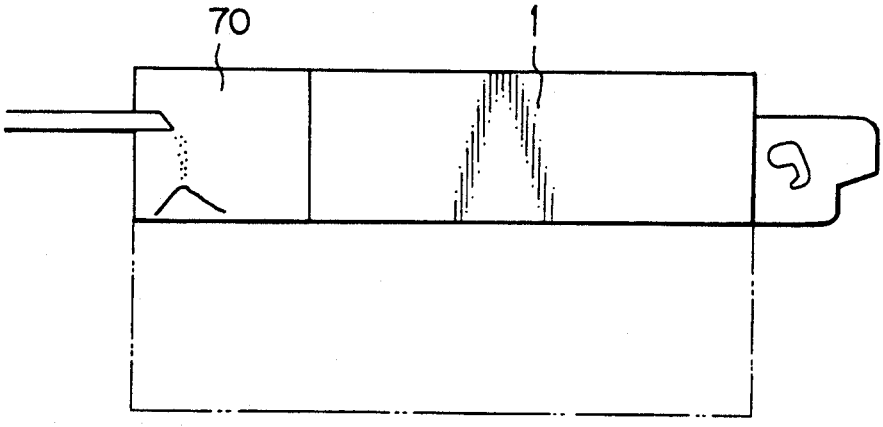
FIG. 22 is a view showing a modified form of the case.

As shown in FIG. 22, a waste toner bottle 70 may be mounted on the end of the toner cartridge 1 remote from the take-up roller 7. This allows the waste toner to be collected in the event of replacement of the toner cartridge 1, freeing the serviceman from extra work for toner collection.

In summary, it will be seen that the present invention provides a toner cartridge which attaches and detaches a seal member automatically, i.e., without resorting to manual work. This not only eliminates contamination ascribable to the scattering of toner but also frees the operator from smears, allowing the toner cartridge to be replaced easily and efficiently. The toner cartridge is prevented from being removed, except for a particular condition, by a locking device, eliminating smears due to the toner. Even when the toner cartridge has a shutter, the shutter is operable efficiently enough to eliminate the leakage of toner. When the shutter is pulled out, an opening formed in the case of the cartridge is automatically opened.

Various modifications will become possible for those skilled in the art after receiving the teachings of the present disclosure without departing from the scope thereof.

What is claimed is:

1. A toner cartridge for supplying a toner to a toner hopper incorporated in a developing apparatus, comprising:

a case having an opening at a bottom thereof;

a sheet-like seal member detachably fitted on said case for covering said opening;

a take-up roller rotatably mounted on said case, said seal member being affixed to said take-up roller at one end thereof, wherein said take-up roller rotates to take-up said seal member to thereby uncover said opening;

a shutter member movably mounted on said case;

a magnet mounted on said shutter member; and a magnet roller operatively connected to said take-up roller;

wherein when said magnet is moved together with said shutter member, said magnet roller is rotated to rotate said take-up roller.

2. A toner cartridge for supplying a toner to a toner hopper incorporated in a developing apparatus, comprising:

a case having an opening at a bottom thereof;

a sheet-like seal member detachably fitted on said case for covering said opening;

a take-up roller rotatably mounted on said case, said seal member being affixed to said take-up roller at one end thereof, wherein said take-up roller rotates to take-up said seal member to thereby uncover said opening;

a shutter member movably mounted on said case; and magnetic sealing means mounted on said case and said shutter member;

wherein the interstice between said case and said shutter member is sealed by magnetic attraction acting between said magnetic sealing means of said case and shutter member.

3. The toner cartridge of claim 2, wherein said magnetic sealing means comprises a flat magnet mounted on each of said case and said shutter member.

4. The toner cartridge of claim 2, wherein said magnetic sealing means includes a magnet mounted on one of the case and the shutter member, and a magnetic member mounted on the other of the case and the shutter member.

5. A toner cartridge for supplying a toner to a toner hopper incorporated in a developing apparatus, comprising:

a case having an opening at a bottom thereof;

a sheet-like seal member detachably fitted on said case for covering said opening;

a take-up roller rotatably mounted on said case, said seal member being affixed to said take-up roller at one end thereof, wherein said take-up roller rotates to take up said seal member to thereby uncover said opening;

said toner cartridge further comprising an adhesive tape accommodated in said case and, when said case is pulled out, closing said opening of said case.

6. A toner cartridge as claimed in claim 5, wherein said developing apparatus comprises a press roller operated by a lever to either one of an operative position and an inoperative position, wherein when said case is pulled out, said adhesive tape is pressed against the edges of said opening of said case by said press roller which is in said operative position, thereby closing said opening.

7. A developing apparatus having a toner cartridge mounted thereon for supplying a toner to a toner hopper incorporated in a developing apparatus, said toner cartridge comprising:

a case having an opening at a bottom thereof said case including a connecting means;

a sheet-like seal member detachably fitted on said case for covering said opening; and a take-up roller rotatably mounted on said case, said seal member being affixed to said take-up roller at tone end thereof;

wherein said take-up roller rotates to take up said seal member to thereby uncover said opening;

said developing apparatus including driving means coupled to the connecting means of said toner cartridge, said connecting means connected to said take-up roller, such that when said toner cartridge is mounted on said developing apparatus, said take-up roller is rotated by said driving means and said connecting means, wherein said driving means includes one-way clutch such that said take-up roller is only driven in a first direction;

the apparatus further including a shutter movably mounted upon the case of said toner cartridge, said shutter coupled to said driving means such that when said toner cartridge is mounted on said developing apparatus movement of said shutter in a first direction causes movement of said take-up roller, and as a result of said one-way clutch movement of said shutter in a reverse direction does not result in movement of said take-up roller.

8. A toner cartridge for supplying a toner to a toner hopper incorporated in a developing apparatus, comprising:

a case having an opening at a bottom thereof;

a sheet-like seal member detachably fitted on said case for covering said opening;

a take-up roller rotatably mounted on said case, said seal member being affixed to said take-up roller at one end thereof, wherein said take-up roller rotates to take up said seal member to thereby uncover said opening;

said toner cartridge further comprising an adhesive tape accommodated in said case for closing said opening after said sheet-like seal member has been taken up by said take-up roller; and an adhesive tape applicator for applying said adhesive tape across said opening.

9. The toner cartridge of claim 8, wherein said adhesive tape is in the form of a roll of adhesive tape, and wherein said roll is movable from a storage position to a position for application to said opening, and wherein said storage position is adjacent said take-up roller such that an increase in a diameter of said take-up roller as said seal member is taken up upon said take-up roller causes said adhesive roll to move from said storage position to the position for application.

* * * * *